United States Patent [19]

Rassieur

[11] 4,393,945

[45] Jul. 19, 1983

[54] ROTARY DRILL WITH A KELLY BAR AND HYDRAULIC CHUCK

[75] Inventor: Charles L. Rassieur, Creve Coeur, Mo.

[73] Assignee: Central Mine Equipment Company, St. Louis, Mo.

[21] Appl. No.: 199,429

[22] Filed: Oct. 22, 1980

[51] Int. Cl.[3] ..... E21B 3/04

[52] U.S. Cl. ..... 173/163; 173/152; 175/122; 279/121

[58] Field of Search ..... 173/163–167, 173/152; 279/87, 121; 175/113–114, 122, 195

[56] References Cited

U.S. PATENT DOCUMENTS

| | | | |
|---|---|---|---|
| 1,812,721 | 6/1931 | Sheldon | 173/164 |
| 2,564,119 | 8/1951 | Mathews | 173/166 |
| 2,768,830 | 10/1956 | Janson | 279/121 |
| 2,854,240 | 9/1958 | Parker et al. | 279/121 |
| 3,561,545 | 2/1971 | Rassieur | 173/166 |
| 4,196,914 | 4/1980 | Kutman et al. | 279/121 |

FOREIGN PATENT DOCUMENTS

| | | | |
|---|---|---|---|
| 1107731 | 1/1956 | France | 279/121 |

*Primary Examiner*—Harold D. Whitehead
*Assistant Examiner*—K. Bradford Adolphson
*Attorney, Agent, or Firm*—Polster, Polster and Lucchesi

[57] ABSTRACT

In a rotary drill having a driven rotary table with an axially directed passage through its center of rotation defined by a hollow spindle, a kelly bar, with annular shoulders, extending through the passage and a chuck mounted on the spindle, plungers are mounted for radial movement in the chuck, into and out of engagement with the annular shoulders on the kelly bar, and fingers are mounted to be moved hydraulically axially to engage the plungers and move them radially.

2 Claims, 4 Drawing Figures

ROTARY DRILL WITH A KELLY BAR AND HYDRAULIC CHUCK

BACKGROUND OF THE INVENTION

This invention is an improvement upon the rotary drill illustrated and described in U.S. Pat. No. 3,561,545. In that patent, a fluted kelly bar is provided with annular shoulders into which plungers project radially and are withdrawn by means of levers operated manually. Because the chuck in which the plungers are mounted rotates with the kelly bar, the rotation has to be stopped to permit the levers to be actuated manually, and the kelly bar released.

One of the objects of this invention is to provide, in a rotary drill of the type described in U.S. Pat. No. 3,561,545 with a kelly bar fluted and shouldered as in that patent, means actuated by a control remote from the chuck for moving the plungers.

Another object is to provide such means that can be operated while the chuck is rotating.

Other objects will become apparent to those skilled in the art in the light of the following description and accompanying drawing.

SUMMARY OF THE INVENTION

In accordance with this invention, generally stated, a rotary drill having a driven rotary table with an axially directed passage through its center of rotation defined by a hollow spindle, and a kelly bar extending through the passage, the kelly bar having annular shoulders, is provided with a housing mounted on the spindle for axial movement with the rotary table but restrained against rotation. A chuck body is mounted on the spindle and extends axially through the housing. Plungers are mounted for radial movement in the chuck body to be moved into engagement with the shoulders and out of engagement with them. A tube, mounted on the chuck body has means for engaging the plungers and moving them radially upon axial movement of the tube. Hydraulic means move the tube axially, selectively. In the preferred embodiment, the hydraulic means includes a hollow piston mounted around a part of the tube and within the housing in such a way as to permit axial movement of the piston with respect to the housing but to restrain rotary movement with respect to the housing, the housing and piston having surfaces defining a chamber into which hydraulic fluid is selectively admitted.

DESCRIPTION OF PREFERRED EMBODIMENT

Figure 1:
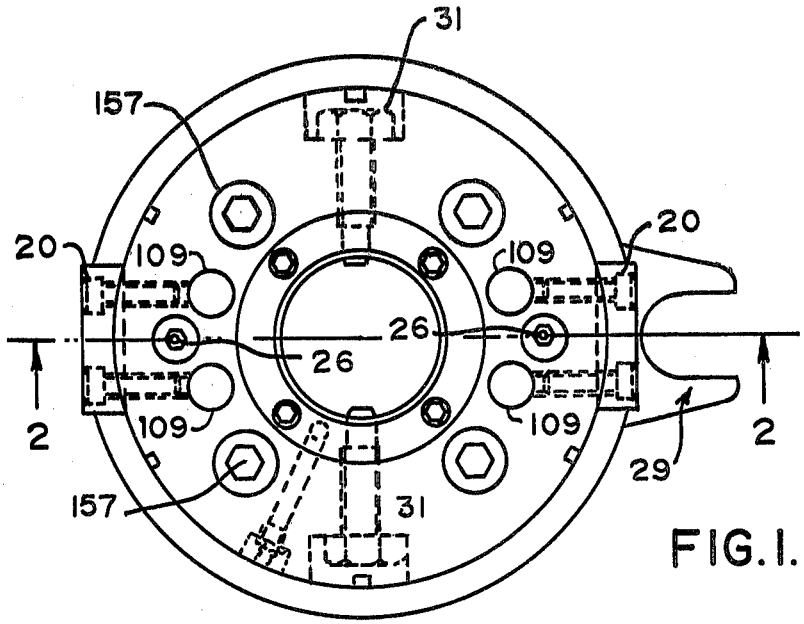
FIG. 1 is a top plan view of one embodiment of hydraulic chuck of this invention.
Figure 2:
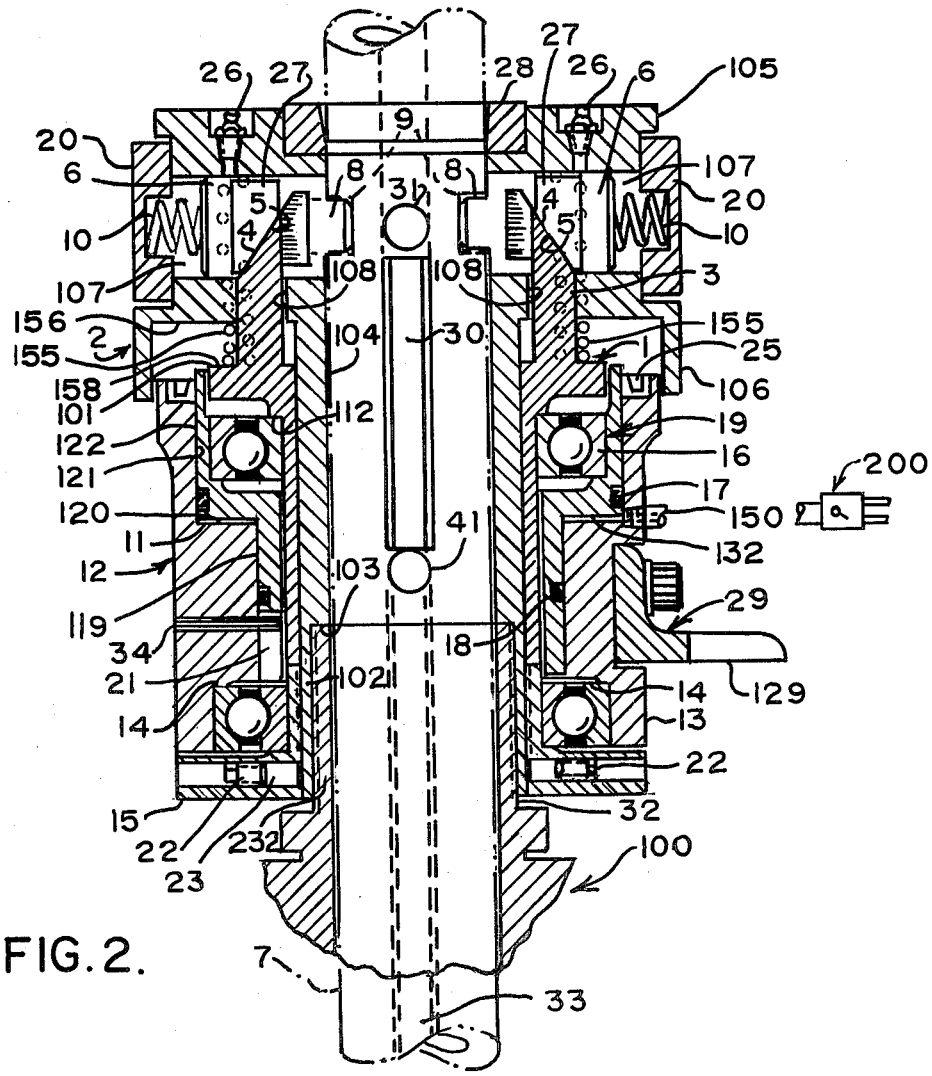
FIG. 2 is a sectional view taken along the line 2—2 of FIG. 1.
Figure 4:
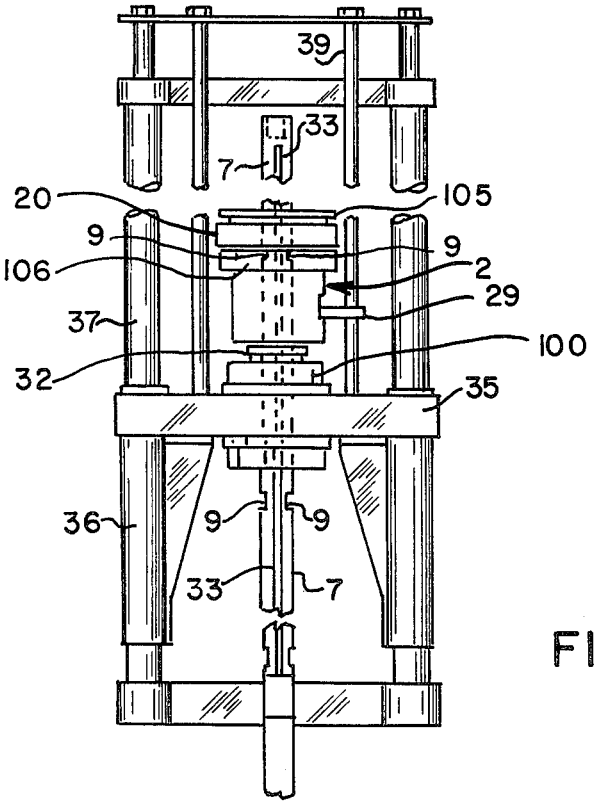
FIG. 4 is a view in front elevation, partly interrupted, of a kelly bar mounting and drive apparatus incorporating the hydraulic chuck of this invention.

Referring now to the drawing for one illustrative embodiment of this invention, and particularly to FIGS. 2 and 4, a kelly bar mounting and drive apparatus of the type shown in U.S. Pat. No. 3,561,545, includes, a rotary table 100 of which a spindle 32 is a part, supported by a yoke 35 mounted on a pair of slide tubes 36 slidably mounted on a pair of hydraulic cylinders 37 for vertical motion thereon. A pair of support rods or stanchions 39 secured to the yoke 35 transmit the motion of pistons in the hydraulic cylinders 37 to the yoke 35. The spindle 32 in this embodiment projects vertically upwardly from the table, and has an externally threaded upper section 232 onto which a tubular chuck body 2 is threaded. The chuck body 2 has an internally threaded section 102 offset radially from the rest of the central bore of the chuck body, terminating in a shoulder 103 of a radial width equal to the thickness of the threaded section 232 of the spindle, so as to permit the bore of the chuck body to define with the spindle a smooth, uninterrupted passage 104.

Figure 3:
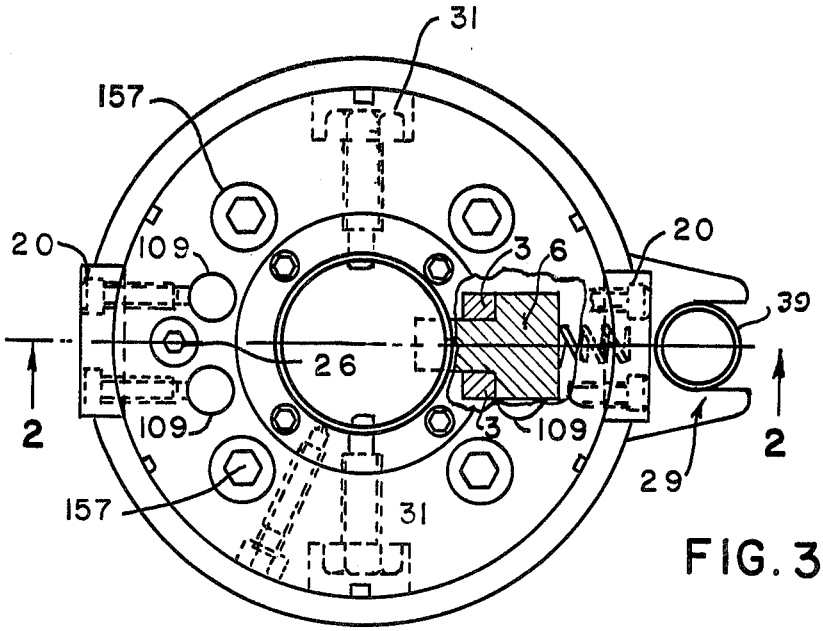
FIG. 3 is a top plan view partly broken away and partly in section of the chuck of FIG. 1.

At its upper end, the chuck body 2 has an axially thick head section 105 with a downwardly depending annular shroud 106 around its lower edge and a radially extending undersurface 156. The head is bored axially at four quadrants from its upper surface through the undersurface 156, to form spring-receiving bores, capped at their upper end with threaded plugs 157. The head 105 is bored diametrically intermediate the spring-receiving bores to provide plunger seats 107 and milled to provide end-cap flats. In this embodiment, the head is also bored axially to provide four finger-receiving passages 108 that open between the underside 156 of the head 105, radially inboard of the shroud, and the seats 107. The passages 108 are spaced symmetrically to either side of and from the axial center line of the seats 107. A closure plug 109 is secured in the superfluous passage between the upper surface of the head and the seat 107. A tube 1 is mounted around and axially slidably on the chuck body 2 below the head 105. The tube 1 has at its upper end a heavy flange section 101, circular in plan, with an upper radial surface 158. Helical compression springs 155, seated in the spring-receiving bores in the head 105, are compressed between the plugs 157 and the upper surface 158. Two pairs of fingers 3, as shown in FIGS. 2 and 3 project from the upper surface 158 through the finger-receiving passages 108 in the head 105. The upper ends of the fingers 3 are chamfered on their radially outer side to provide tapered cam surfaces 4 that engage mating cam surfaces 5 on either side of plungers 6 (see FIG. 3).

The plungers 6 are slidably mounted for movement radially in the seats 107. They are provided with flats adjacent the cam surfaces to accommodate the fingers 3, pairs of which straddle each plunger, as illustrated in FIG. 3. Each plunger is continuously biased radially inwardly by a spring 10, seated at one end in a well in an end cap 20 bolted to the flat on the chuck body 2 and at its other end, in a well extending within the plunger body a substantial distance, in the direction of a nose 8, between and spaced inwardly from the flats, as shown in FIG. 3. The nose 8 on each plunger 6 is sized to project closely into milled chordal slots 9 in a kelly bar 7 of the same general description as the kelly bar described in U.S. Pat. No. 3,561,545. The kelly bar also has axially extending keyways 33.

The tube 1 has a relatively thin cylindrical section stepped radially outwardly in the arris with the flange 101 to form a bearing-engaging shoulder 112, which engages the upper surface of an inner race of a roller bearing 16, the outer race of which rests upon and is supported by a shoulder on an upper surface of the bottom wall of a cup-shaped upper end of a piston 19. The piston 19 has a cylindrical skirt 119, with an axial slot 21 extending upwardly from its lower edge, into which a pin 34 extends. The pin 34 is mounted in a radial passage in a housing 12. The housing 12 is also generally cylindrical. At its lower end it is stepped radially outwardly from its inner surface to provide a seat for a lower bearing 13 the outer race of which engages a shoulder 14 of the housing. About midway of its height, the housing 12 is also stepped radially outwardly from its inside surface, to provide a radially extending annular surface 120 facing but spaced from a corresponding surface 132 of the piston 19. An inside, cylindrical surface 121 of the housing above the radial annular surface 120 closely surrounds a complementary surface 122 of the upper end of the piston 19. An annular seating channel is provided in the surface 122, in which an O-ring 17 is seated. Another O-ring 18, is seated in a channel in the outer wall of the skirt of the piston 19, which is surrounded by and closely fitted within a complementary wall of the housing 12.

The inner race of the lower bearing 13 rests upon a shoulder of a lock collar 15. The lock collar 15 has a sleeve section that screws onto an externally threaded lower end of the chuck body 2. The lock collar is locked in place by retaining screws 22 forcing nylon inserts 23 against the threads of the chuck body.

Diametrically opposed keyways are machined in the inner wall of the chuck body 2, in which keys 30 are seated to project radially inwardly. Retaining screws 31, extending through counterbored holes in the chuck body, prevent the keys 30 from shifting upwardly axially. Plugs 41 prevent the keys from shifting downwardly.

Grease fittings 26 in the head 105 communicate with the seats 107. The plungers 6 have shallow circumferential grooves 27 in them which permit grease to reach the cam surfaces. A hardened, wear-resistant wear ring 28, set into a seat in the head of the chuck body, protects the chuck body itself from wear. A seal ring 25, mounted in a stepped seat at the upper edge of the housing 12, serves to inhibit the entrance of dirt and moisture between the surfaces 121 and 122.

The housing 12 is prevented from rotating but permitted axial movement with respect to the drill rig by a retainer 29, bolted securely to the housing. The retainer 29 has spaced legs 129 that straddle a stationary upright stanchion 39 of the rig, as shown in FIGS. 3 and 4.

A suitable pressure and vent hydraulic fitting 150, communicating with a chamber 11 defined by the surfaces 120 and 132, permits the introduction of and escape from the chamber of hydraulic fluid from and to a conventional hydraulic system 200 indicated schematically. The system 200, including valves and a source of fluid under pressure, is sometimes referred to as the control or control system, and, as indicated, is located remotely from the housing 12 but operatively connected to it by means of a flexible hose.

In operation, the plungers 6 are biased radially inwardly by the springs 10. Assuming that the fingers are in their retracted position, as shown in FIG. 2, as the kelly bar is raised or lowered, the nose 8 of the plungers will snap into the first set of milled slots that pass by. The key 30, extending into the keyway 33 of the kelly bar, prevents relative rotation of the kelly bar and the chuck body 2, but permits axial movement of the kelly bar with respect to the chuck body.

The housing 12 is prevented from rotating by the retainer 29. When the spindle 32 is rotated, it rotates the chuck body 2. Because the chuck body is keyed to the kelly bar, it also rotates the kelly bar. Because the fingers 3 of the tube 1 project through passages in the head of the chuck body, the tube 1 also rotates with the chuck body and the kelly bar. The piston 19 is held against rotation by the pin 34 mounted in the housing 12. The lock collar 15, being mounted tightly on the chuck body, also rotates. The bearings 13 and 16 permit easy relative rotation of the parts. When it is desired to disengage the kelly bar from the chuck, hydraulic fluid is admitted to the chamber 11, which forces the piston 19 axially upwardly, causing the cam surfaces 4 of the fingers 3 to ride up on the cam surfaces 5 of the plungers, moving the plungers radially outwardly and forcing the noses 8 of the plungers out of the milled slots in the kelly bar. The kelly bar and the entire chuck are now free to move axially with respect to one another. Thus, if it is desired to force the kelly bar downwardly, the chuck is moved axially upwardly with respect to the kelly bar, the hydraulic fluid is permitted to escape from the chamber 11, the bias of the springs 155 and to some extent the springs 10 force the tube and piston downwardly, and the noses 8 snap into the next set of milled slots in the kelly bar. If in the operation of the rig, hydraulic pressure is then applied, through cylinders not here shown, to force the rotary table and chuck downwardly, the noses 8, engaging the lower slot-defining shoulder of the milled slot, will force the kelly bar to move downwardly. If the rotary table and chuck are forced upwardly, the noses 8 engage the upper slot-defining shoulder of the milled slot, forcing the kelly bar to move upwardly. Because the chuck body, hence the plungers, rotate with the kelly bar, the plungers can be withdrawn from the slots in the kelly bar and the chuck repositioned axially with respect to the kelly bar, while the kelly bar is being rotated.

It can be seen that because the hydraulic fitting 150 is mounted in the housing 12, the hose connected thereto need only move up and down.

Numerous variations in the construction of the hydraulic chuck of this invention, within the scope of the appended claims, will occur to those skilled in the art in the light of the foregoing disclosure. Merely by way of illustration, the spindle can be inverted, although the upwardly extending spindle arrangement tends to provide a more nearly fail-safe arrangement, because the piston and tube are gravity-biased toward a position in which the plungers engage the kelly bar shoulders. Provision can be made for making the piston double-acting. The size and configuration of various of the elements can be changed. These are merely illustrative.

I claim:

1. In a rotary drilling apparatus wherein a rotary table is adapted to be moved axially while rotating, said rotary table including a spindle having an axially directed passage through it as its center of rotation, a kelly bar extending through said passage, means carried by the rotary table for transmitting positive rotational force from the rotary table to the kelly bar, said kelly bar having shoulder means having radial shoulder surfaces, elongated plunger means carried by said rotary table for selectively engaging and disengaging said kelly bar shoulder surfaces and actuating means carried by said rotary table for causing said plunger means to engage with and disengage from said shoulder means, the improvement comprising a tubular housing, means for holding said housing against rotation and to permit axial movement of said housing with said table, a chuck body mounted on said spindle and extending axially within and for rotation with respect to said housing, said plunger means being mounted for radial movement in said chuck body, said plunger means having cam surfaces on opposite sides of them intermediate their ends; said actuating means comprising a tube mounted on said chuck body for axial movement with respect thereto, said tube having spaced fingers, straddling said plunger means, each with a wedge-shaped camming surface for engaging the said cam surfaces of said plungers and moving said plungers outwardly radially upon axial movement of said tube to disengage said plungers from said kelly bar shoulder means, hydraulic means for moving said tube axially selectively, and means for biasing said plungers toward and into engagement with said kelly bar shoulder means when said tube camming means are moved away from said plungers.

2. The improvement of claim 1 wherein said hydraulic means includes a hollow piston mounted around a part of said tube and within said housing, means for restraining rotary movement of said piston with respect to said housing and for permitting axial movement of said piston with respect to said housing, said housing and said piston having surfaces defining a chamber, and means for selectively introducing hydraulic fluid to and draining hydraulic fluid from said chamber.

* * * * *